United States Patent [19]

Sochor

[11] Patent Number: 4,889,499

[45] Date of Patent: Dec. 26, 1989

[54] ZERO INSERTION FORCE CONNECTOR

[75] Inventor: Jerzy Sochor, Santa Cruz, Calif.

[73] Assignee: Amdahl Corporation, Sunnyvale, Calif.

[21] Appl. No.: 196,726

[22] Filed: May 20, 1988

[51] Int. Cl.[4] ..... H01R 13/62

[52] U.S. Cl. ..... 439/268

[58] Field of Search ..... 439/259, 261–266, 439/268–270

[56] References Cited

U.S. PATENT DOCUMENTS 3,489,986 1/1970 Frederick ..... 439/259
4,468,072 8/1984 Sadigh-Behzadi ..... 439/266

FOREIGN PATENT DOCUMENTS 3008841 9/1980 Fed. Rep. of Germany ..... 439/259

OTHER PUBLICATIONS

"Development of Interconnection Technology for Large-Scale Integrated Circuits", R. Babuka et al, IBM J. Research & Development, vol. 26, No. 3, May 1982, p. 318.
"Zero Insertion Connector with Individually Replaceable Contacts", IBM bulletin, vol. 17, No. 2, Jul. 1974.
"Enhanced Zero Insertion Connector", IBM bulletin, vol. 18, No. 10, Mar. 1976.
"A ZIR Connector for Pin Grid Arrays", Electronic Products, pp. 99–102, Oct. 24, 1983.
Seventeenth Annual Connectors and Interconnection Technology Symposium Proceedings, Electronic Connector Study Group, Inc., Sep. 19–21, 1984.

*Primary Examiner*—Gary F. Paumen
*Attorney, Agent, or Firm*—Fliesler, Dubb, Meyer & Lovejoy

[57] ABSTRACT

A pin grip array zero insertion force connector has 10,000 or more normally closed contacts provided in rows on a motherboard. Alternating rows of contacts respectively include first and second type contacts, and drawbars are provided between the rows of contacts. Alternate drawbars are caused to slide in opposite directions, thereby engaging the drawbars with one of the two tines of each contact in the rows of contacts on either side of the drawbar. An actuator mechanism is provided at each end of the rows of contacts and drawbars to engage and slide the drawbars. To reduce the force necessary to operate each actuator mechanism, the actuator mechanisms may be divided into subactuator mechanisms which are individually actuated. The drawbars comprises a drawbar support strip which engages the actuator mechanisms and an interposer body molded to retaining tabs on the drawbar support strip.

28 Claims, 7 Drawing Sheets

ZERO INSERTION FORCE CONNECTOR

BACKGROUND OF THE INVENTION

1. Field of the Invention

The present invention relates to pin grid array (PGA) zero insertion force (ZIF) connectors.

2. Description of the Related Art

Pin grid array zero insertion force connectors are well known in the electronics industry for connecting a large number of connector pins on a mating device with contacts in the PGA ZIF connector. Conventional PGA ZIF connectors have limits imposed on both the total number of contacts in the connector and the minimum pitch of the contacts imposed by the dimensional and structural integrity of plastic housings and plastic actuator components. For example, molded plastics exhibit "post-mold shrinkage," a phenomenon which causes a reduction in the dimensions of a molded part as the plastic hardens. Post-mold shrinkage can be anticipated and designed for; however, it is difficult to provide the accurate dimensional tolerances needed for PGA ZIF connectors having many thousands of contacts. As the size of the mold increases, problems with post-mold shrinkage. become more acute, and, further, it becomes more difficult to assure that the molds are filled with plastic.

Dimensional accuracy in PGA ZIF connectors is important for two reasons. First, the positions of the contacts must correspond to a standard matrix which is identical to the matrix of the connector pins to be inserted into the contacts. Disparities in positions can cause an inability to mate the contacts with the pins and may result in poor electrical connections between the contacts and pins.

Second, the actuator which opens or closes the contacts or forcibly engages the pins with the contacts must not introduce large variations in the contact force, which would create poor contacts at very low or marginal contact pressure or damage to contacts due to excessive contact pressures.

The limitations of conventional PGA ZIF connectors are exemplified by reference to several conventional designs. A first conventional design for a PGA ZIF connector is disclosed in "A ZIF Connector For Pin Grid Arrays," Harvey R. Waltersdorf, Electronic Products, Oct. 24, 1983. This design cannot be used with more than 1,000 contacts, at least in part due to a lack of dimensional and structural stability of its molded plastic actuator components. The normally closed contacts of this design are opened by sliding an actuator in a horizontal plane which causes a cam to slide up ramp-risers thereby moving the cam in a vertical plane to open the contacts. The forces necessary to operate this system increase dramatically as the size of the connector increases—particularly since the actuator and the cam are frictionally engaged; these actuation forces place great stresses on the actuator.

A second design proposed by ITT Cannon, "Zero Force Matched Impedance Pin Array Interconnecting System," Seventeenth Annual Connectors and Interconnection Technology Symposium Proceedings, Sept. 19–21, 1984, is indicated to be useful with 1000 connectors in a 4×4 inch array. The single-tine contacts of the ITT cannon design provide only a single point of contact with each mating device connector pin, and thus have a lack of redundancy which may be a critical requirement in high reliability applications. Electrical concretions between the contacts and connector pins are made by providing a force which deforms the contacts to engage the contacts with the connector pins. Contact beam length is critical to device performance because the spring force (contact force) of each contact varies with the cube of the beam length. Beam length is defined as the distance between the point at which the contact is supported by a printed circuit board and the contact point. The contacts are mounted in holes in the circuit board with solder, and thus beam length is directly related to the volume of solder in the hole in the circuit board. Since the amount of solder utilized per contact is difficult to control, variations in the beam length are unavoidable. Further, solder is not a good structural material due to its inherent malleability. In addition, the contacts are all simultaneously deformed by an actuator frame. Difficulties in maintaining dimensional tolerances in the actuator frame create large variations in contact force at different pin positions through the connector.

A PGA connector having 1800 pins has been proposed by IBM. The IBM PGA connector design is not a true ZIF connector since all of the contacts are simultaneously slidably engaged with connector pins during insertion of the connector pins into the PGA connector. See "Development of Interconnection Technology for Large Scale Integrated Circuits," IBM Journal R&D Vol. 26, No. 3, May, 1982, R. Babuka et al. This concept is not practical for large PGA devices because contact pressure is compromised by the need to reduce the total module engagement force. The sliding engagement of the contacts and connector pins requires actuating forces which cannot feasibly be provided when this design is used with a large number of contacts. In addition, the sliding engagement of the contacts and connector pins creates serious reliability problems due to susceptibility to damage of the small-diameter connector pins needed for high pin densities.

In summary, existing designs of ZIF connectors are not applicable for use with significantly higher contact counts due to the following factors: (1) problems with post-mold shrinkage and warp, and mold filling for larger molds; (2) the impacts of component and assembly tolerances on contact force and device stresses; (3) excessive actuating loads—especially those encountered when all contacts are actuated simultaneously by a single plastic actuator; (4) the complexity of the actuators; and (5) the inability to utilize a continuous pin field when the connector is segmented in order to divide the high actuating forces. In particular, it is not possible to produce large, e.g., 8–10 $in^2$, connectors with a high number of pins, e.g., 10,000, having a pitch of less than 100 mils which are essential if a single connector is to be provided for a large chip carrier substrate holding, for example, 144 chips in a 12×12 array.

SUMMARY OF THE INVENTION

It is, therefore, an object of the present invention to provide pin-grid array (PGA) zero insertion force (ZIF) connectors for high pin count devices.

A further object of the present invention is to provide a ZIF PGA connector utilizing a contact system having improved dimensional tolerances.

Another object of the present invention is to provide a PGA ZIF connector having ten thousand (10,000) or more contacts.

Another object of the present invention is to provide a PGA ZIF connector which in a single connector provides connections to a large array of connector pins, e.g., 8–10 in.$^2$, provided on a large chip barrier substrate having, for example, 144 chips, mounted thereon.

Another object of the present invention is to provide a PGA ZIF connector having uniform and redundant contact forces for all of the contacts.

Another object of the present invention is to provide a PGA ZIF connector having a low actuation force.

Another object of the present invention is to provide a PGA ZIF connector having sequential actuation of various segments of the connector.

Another object of the present invention is to avoid sliding engagement of the contacts of the PGA ZIF connector and the connector pins of the mating device.

A PGA ZIF connector in accordance with the present invention comprises a plurality of normally closed contacts provided in rows on a motherboard, actuator means adjacent to each row of contacts for engaging the contacts, and means for moving alternate actuator means in opposite directions to engage the actuator means with the contacts to open the contacts. When the contacts are opened connector pins are inserted between the tines of the opened contacts and the actuator means are then moved in the opposite direction to allow the spring force of the contact to create connections between each contact and its associated connector pin. Each contact includes a pair of opposed tines (front and back tines) and each tine includes an actuation tab (or ear). Alternating rows of contacts have first and second type contacts; the front tines of the first type contacts engage actuator means which move in one direction and the back tines of the first type contacts engage actuator means which move in the other direction; the front tines of the second type contacts engage actuator means which move in the other direction and the back tines of the second type contacts engage actuator means which move in the one direction. Each actuator means comprises an actuator drawbar which is reinforced by a metal drawbar support strip to provide dimensional stability. Groups of actuator means are slidably moved by separate actuator or camming means, thereby dividing the total force necessary to move all of the actuator means.

DESCRIPTION OF THE PREFERRED EMBODIMENT

A pin grid array (PGA) zero insertion force (ZIF) connector in accordance with the present invention will be described with reference to FIGS. 1–10. The PGA ZIF connector of the present invention is intended to provide a connector having ten thousand (10,000) or more contacts; however, the principles of the PGA ZIF connector of the present invention are applicable to PGA ZIF connectors having less than 10,000 contacts.

Figure 1:
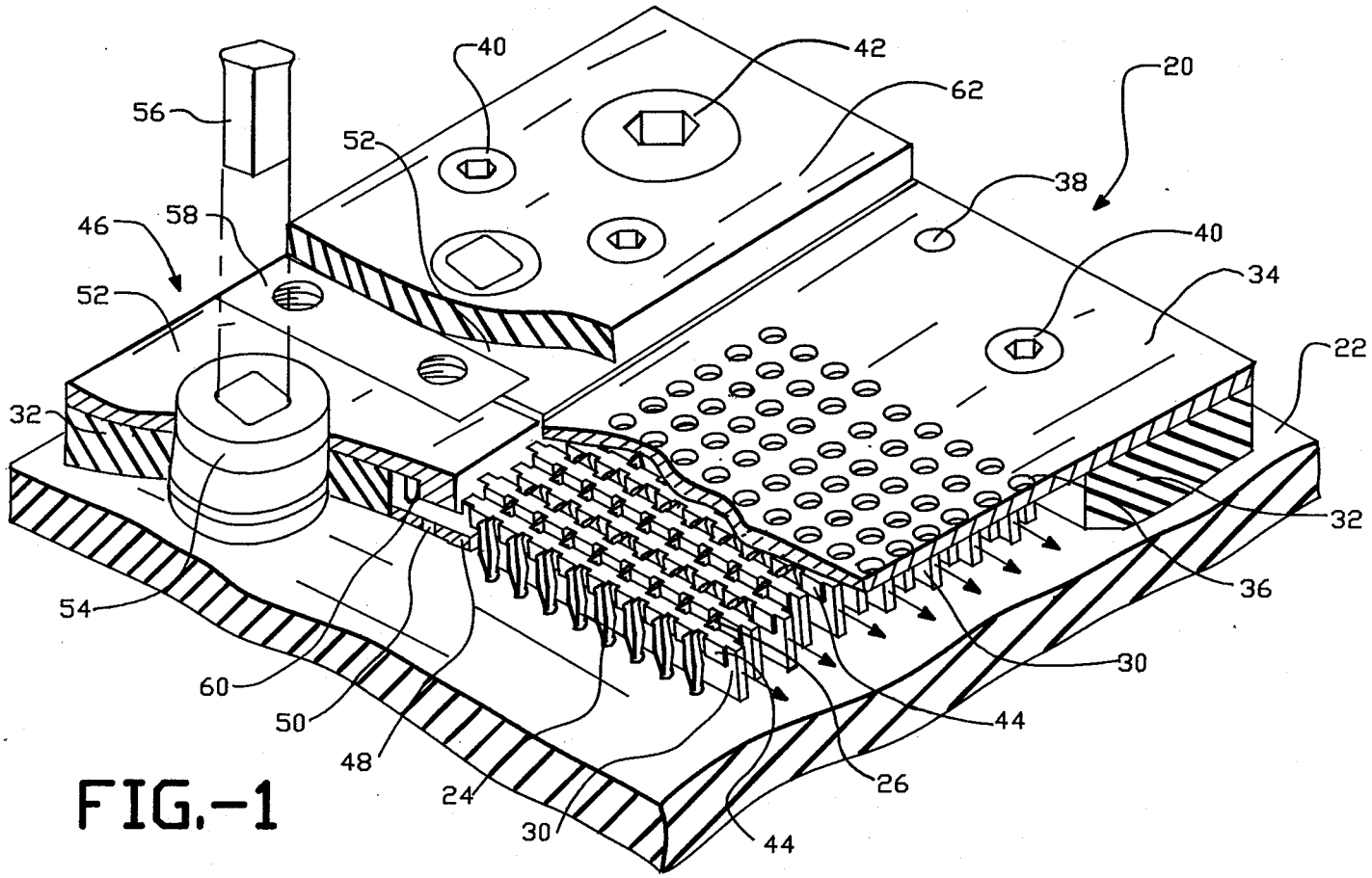
FIG. 1 is partial isometric view of a PGA ZIF connector in accordance with the present invention.
Figure 2A:
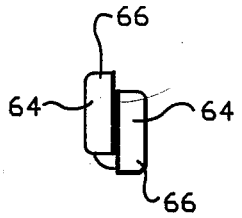
FIGS. 2A–2C are top views of normally closed dual-leaf contact in accordance with the present invention in various stages of operation.
Figure 2B:
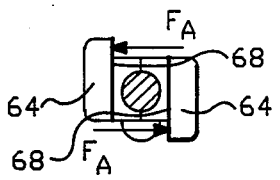
Figure 2C:
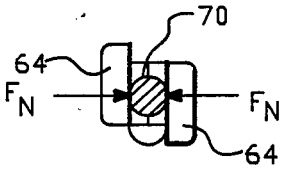
Figure 2D:
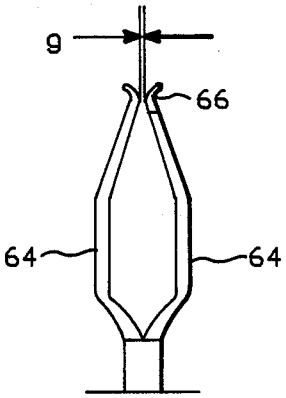
FIGS. 2D–2F are side views of normally closed dual-leaf contact in accordance with the present invention in various stages of operation.
Figure 2E:
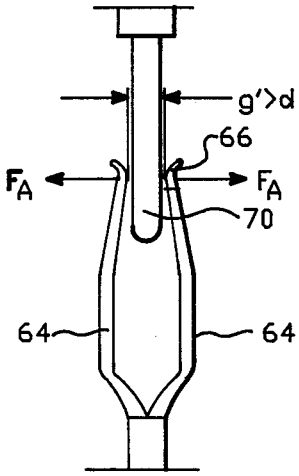
Figure 2F:
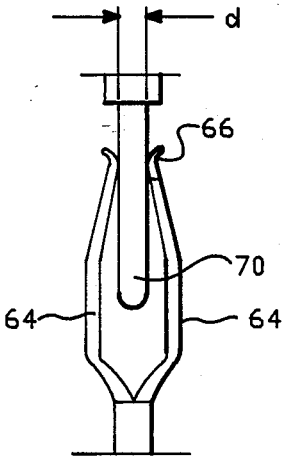
Figure 3A:
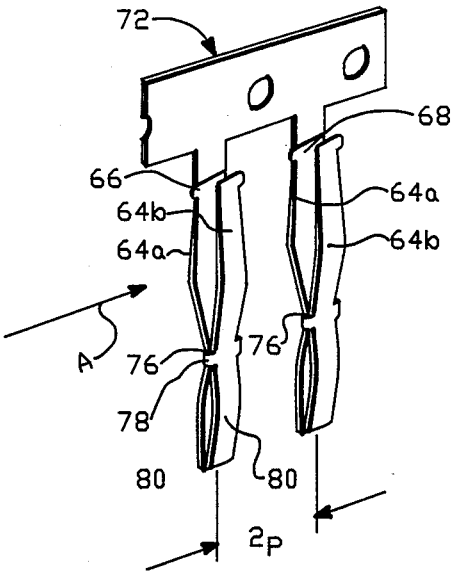
FIG. 3A is a partial isometric view of first type contacts in accordance with the present invention.
Figure 3B:
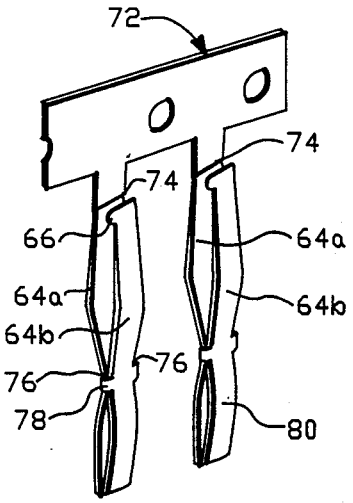
FIG. 3B is a partial isometric view of second type contacts in accordance with the present invention.

A general description of the PGA ZIF of the present invention connector will be provided with reference to FIG. 1. Specific elements and principles are described in more detail with respect to FIGS. 2–10. The PGA ZIF connector of the present invention includes a motherboard having plated through holes 23. Contacts 24 are press fit in plated through-holes 23 in motherboard 22. Alternatively, surface mounted contacts could be utilized, or contacts 24 having a solid pin (not shown) could be soldered into plated through-holes 23. First and second type contacts 25, 26 are arranged in alternating rows of, for example, 100 contacts; thus, a 10,000 contact connector could have 100 rows of 100 contacts each. In the preferred embodiment of the present invention, contacts 24 have a pitch of 0.080 inches (80 mils) or less.

Actuator drawbars 30 are provided between the alternating rows of first and second type contact 25, 26. A frame 32 surrounds the portion of motherboard 22 where contacts 24 are provided and a cover 34 having apertures 36 is securely positioned so that apertures 36 are aligned with contacts 24. The cover 34 is positioned by locating pins 38 and secured to frame 32 by cover screws 40. The frame 32 and cover 34 are secured to motherboard 22 by frame mounting bolts 42. The cover 34 protects contacts 24 and actuator drawbars 30, and apertures 36 have a taper to provide a lead-in for the PGA pins (not shown) which mate with contacts 24.

Contacts 24 are normally closed dual leaf type contacts which are opened by sliding alternate actuator drawbars 30 in opposite directions to engage interposers 44 of drawbars 30 with contacts 24. Interposer 44 on opposite sides of each drawbar 30 respectively engage first and second type contacts 25, 26. Camming (actuator, actuating) mechanisms 46 are provided at opposite ends of the rows of contacts 24 and drawbars 30 to slide the alternate drawbars 30 in opposite directions. Drawbars 30 are positioned and guided by guide plates 48 which are preoisely located on motherboard 22 by guide plate looating pins 50. Camming mechanisms 46 each include a camming slide 52 and an eccentric 54.

A camming slide 52 engages and slides drawbars 30 in a direction parallel to the rows of contacts 24. Camming slide 52 is caused to slide by rotation of eccentric 54 with actuator tool 56. To reduce the force necessary to move camming slide 52, the camming slide 52 may be separated into several sections each of which are moved by an individual eccentric 54. Slide guide walls 58 are provided between the sections of camming slide 52. A return spring 60 is provided at the return end of each drawbar 30 to aid in returning the drawbar to a rest position when contacts 24 are closed. A slide cover 62 is placed over the sections of the camming slide 52.

In operation an actuator tool 56 is used to slide the drawbars 30 connected to each section of camming slide 52 to a position which opens contacts 24. The camming slides 52 at each end of the rows of contacts 24 must be actuated so that both tines 64 of each contact 24 are flexed to the open position. Connector pins 70 are then inserted between the tines 64 of contacts 24 and the camming slides 52 are moved in the opposite direction, with the aid of return springs 60, returning drawbars 30 to the rest position so as to completely disengage drawbars 30 from contacts 24.

The normally closed dual leaf contacts of the present invention will be described with reference to FIGS. 2A–F and 3. Contacts 24 of the first and second contact types 25, 26, each include a pair of opposed tines 64, each tine having an actuation tab (or ear 66. FIGS. 2A–F show a first type contact 25—the difference between first and second type contacts 25, 26 being illustrated in FIGS. 3A and 3B. When viewed from the side (direction A), the visible actuation tab 66 is on the right tine of a first type contact 25 and on the left tine of a second type contact 26.

In the free-state condition, (FIGS. 2A and 2D), contact or mating surfaces 68 of tines 64 are separated by distance g (FIG. 2D) which is less than the diameter d of a connector pin 70. The contact 25 is opened by a force $F_A$ (provided by drawbars 30 on each side of the contact 25) so that the contact surfaces 68 of tines 64 are separated by distance g' which is greater than the diameter d of a connector pin 70 (FIGS. 2B and 2D), thereby allowing a connector pin 70 to be inserted into the contact 25 without engaging contact 25 or encountering a contact force. Force $F_A$ is then removed and the contact tines 64 provide a normal force $F_N$ which provides the electrical contact between contact 24 and connector pin 70. The normal force $F_N$ is proportional to the stiffness of the contact tines 64 and the difference between the connector pin diameter d and the contact gap dimension g in the normally closed condition.

With normally closed contacts the drawbars 30, which provide the force $F_A$, are completely disengaged from the contacts 24 when the contacts 24 are mated with connector pins 70. Therefore, the normal contact force $F_N$ is not affected by the dimensional tolerances or structural stability of the actuator mechanism 46 or actuator drawbars 30.

Contacts 24 are formed by stamping and are attached to a continuous carrier strip 72. The carrier strip 72 is removed at break-off score 74 after the contacts are gang installed in motherboard 22. Contacts 24 are pressed into plated through holes in the motherboard 22 using an installation tool which applies a balanoed pressure to the press-fit installation shoulders 76 on each side of the contact body portion 78 of each contact 24. Compliant pins 80 deform when the contacts are press-fit into the motherboard 22 to accommodate manufacturing tolerances and to provide a spring pressure reserve at the interface of the compliant pin 80 and the plated through-hole in the motherboard 22.

The press-fit method is useful for very large PGA ZIF connectors because it assures precise positioning of the contacts 24 on motherboard 22. In particular, no molded insulator is required, and thus very large size connectors can be fabricated. The compliant press-fit approach also allows easy replacement of worn or damaged contacts 24 without requiring the contacts 24 to be de-soldered from the motherboard 24.

The present invention is described for use with normally closed contacts. However, the invention may be used with normally open contacts which are closed by the actuation of drawbars 30.

Figure 4:
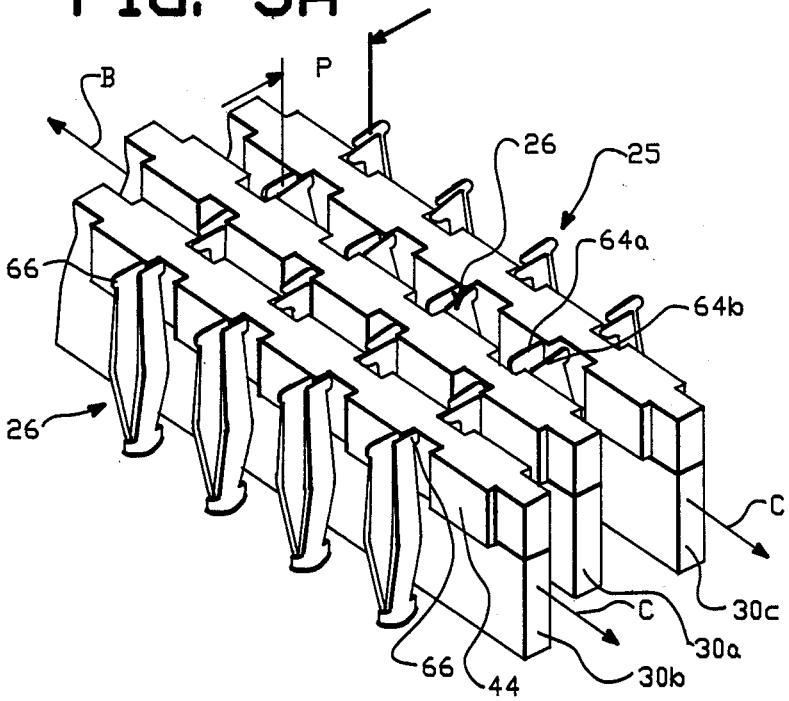
FIG. 4 is a partial isometric view showing the contacts and actuator drawbars of the present invention.
Figure 5A:
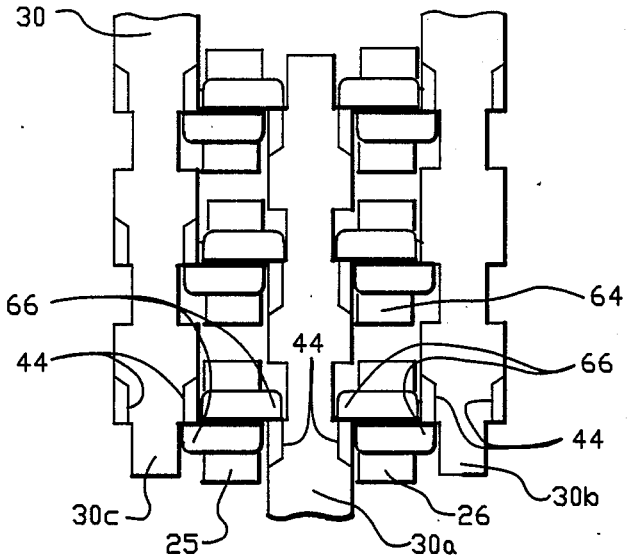
FIGS. 5A–B are partial top views of the contacts and actuator drawbars.
Figure 5B:
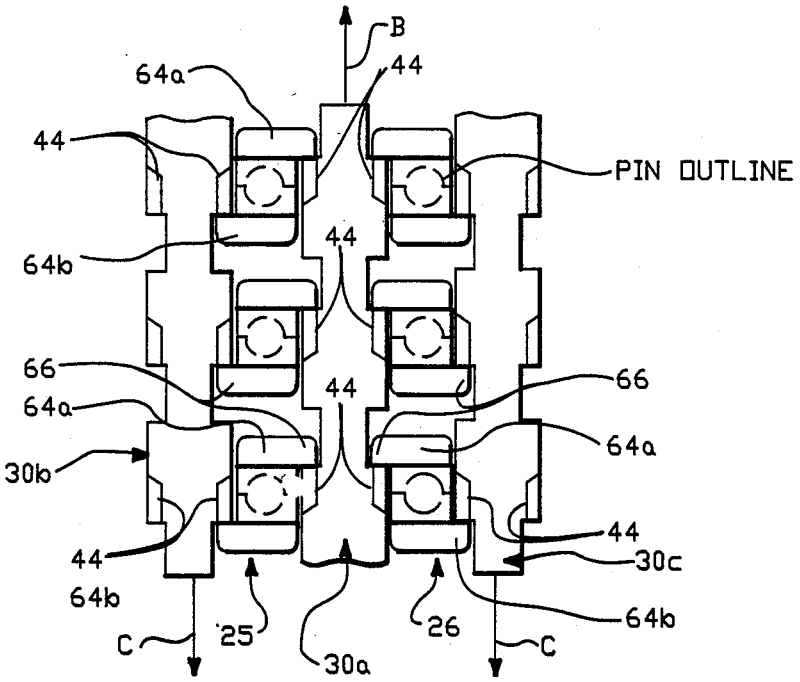

The interaction of drawbars 30 and contacts 24 will be described with reference to FIGS. 4, 5A and 5B. FIGS. 5A and 5B show two rows of contacts 24 in the closed position—a first row of first type contacts 25 and a second row of second type contacts 26—and three drawbars 30. To open the contacts 25, 26 alternate drawbars 30 are caused to move in opposite directions as shown in FIGS. 4 (FIG. 4 illustrates four rows of contacts 24 and three drawbars 30) and 5B; the center drawbar **30*a* moves in the direction indicated by arrow B and the two outer drawbars 30*b, c* move in the direction indicated by arrows C. Moving drawbars 30*a–c* in this manner engages interposers 44 of the drawbars 30*a–c* with actuation tabs 66 of contacts 25, 26. In particular, since the two rows of contacts 25, 26 are of different types, the back tines 64*a* of both types of contacts 25, 26 are engaged by the center drawbar 30*a* and the front tines 64*b* of both types of contacts 25, 26 are engaged by the outer drawbars 30*b, c*. Thus, the front and back tines 64*a, b* of each contact 25, 26 are spread or separated to allow connector pins 70 to be inserted between the tines 64*a, b*. After connector pins 70 are inserted into contacts 25, 26, drawbars 30*a–c* are caused to move in the opposite direction, allowing the spring force of the tines 64*a, b* ($F_N$) to create an electrical contact between the tines 64*a, b* the connector pins 70**.

As described with reference to FIG. 1, camming (or actuating) mechanisms 46 are provided at both ends of the rows of contacts 24 and drawbars 30. Thus, a first camming mechanism **46*a* at one end of the drawbars 30 pulls one group of alternate drawbars and a second camming mechanism 46*b* at the other end of the drawbars 30 pulls the other group of alternate drawbars (as discussed in more detail with reference to FIGS. 9 and 10)—the two groups of alternate drawbars 30 being pulled in opposite directions. In the preferred embodiment of the present invention each camming mechanism moves the associated drawbars 30 and accordingly the contact tines 64 approximately 16 mils (0.016"), requiring a pulling force of approximately 150 g per tine 64. For a 100×100 contact array each drawbar 30 pulls 200 tines 64, requiring a pulling force of approximately 30 Kg. Contacts 64** are designed to allow for a deflection of as much as 20–24 mils (0.020–0.024") without damage, i.e., plastic deformation.

The PGA ZIF connector 20 of the present invention may have as many as 10,000 contacts arranged in an array having a 70 mil pitch (See dimension P in FIG. 4) on a motherboard 22 having a contact insertion area of 64–100 square inches. This area corresponds to the area of a large chip carrier substrate serving as a package for 144 integrated circuit chips arranged, for example, in a 12×12 array. These chip carrier substrates must be field replaceable, thereby creating the need for a single PGA ZIF connector having large dimensions and being capable of incorporating an order of magnitude more contacts than conventional PGA ZIF connectors.

Figure 6B:
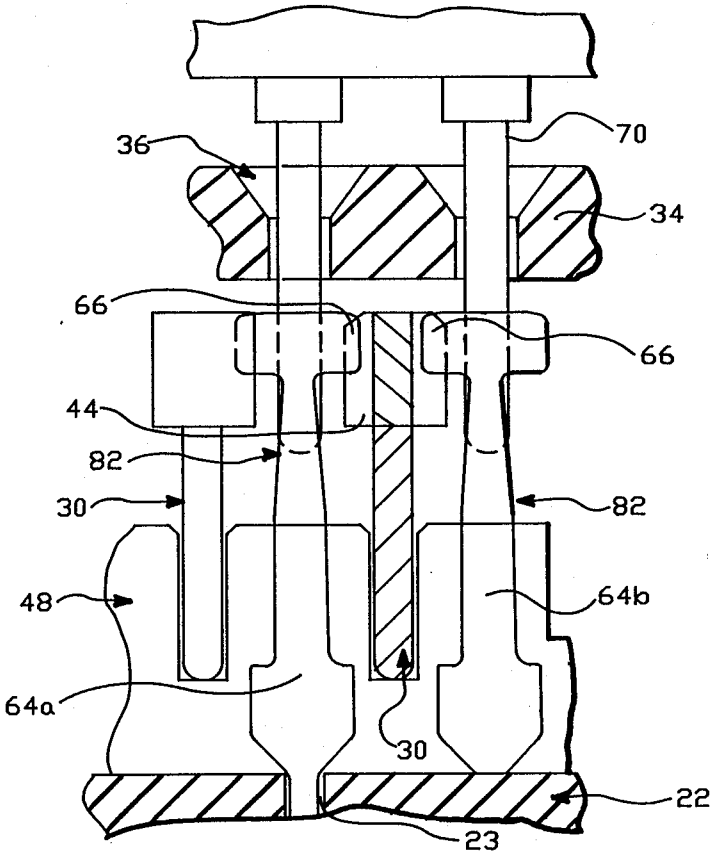
FIGS. 6A–B are partial sectional views of the contacts of the present invention mated with connector pins.
Figure 6A:
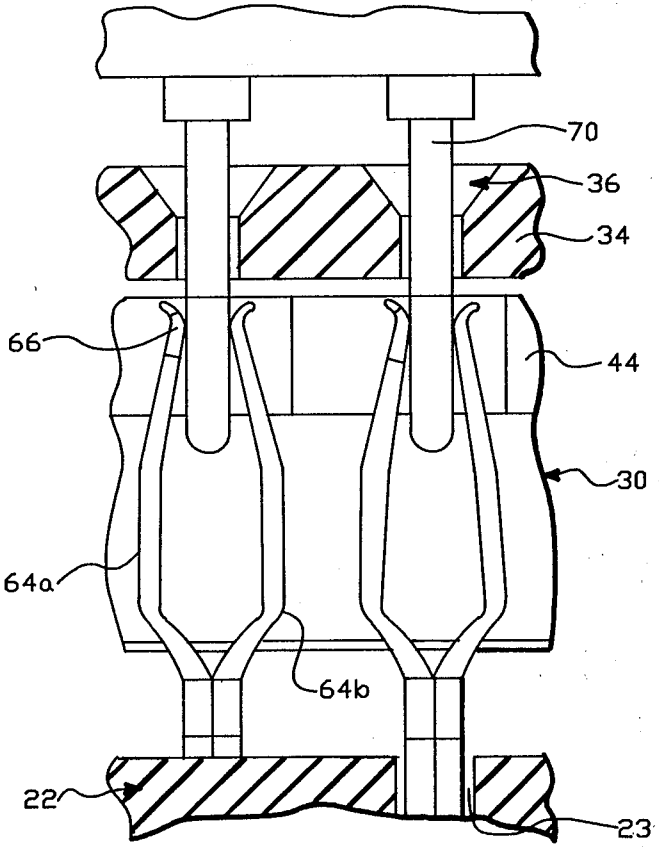
Figure 7B:
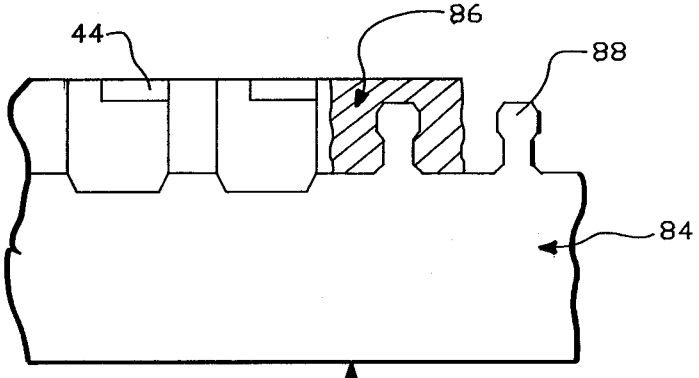
FIG. 7B is a partial cutaway side view of an actuator drawbar.
Figure 7A:
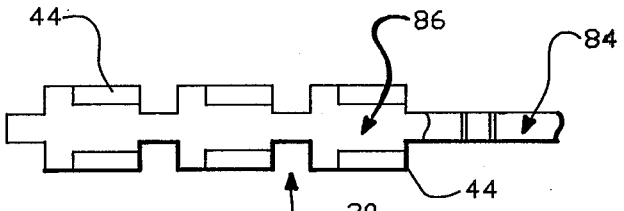
FIG. 7A is a top view of an actuator drawbar.

FIGS. 6A and 6B illustrate contacts 24 of a PGA ZIF connector in accordance with the present invention mated with connector pins 70. FIG. 6B also illustrates the tapered portion 82 of tines 64 which maximize the area of actuator tab 66 which engages with interposer 44 of actuator drawbar 30. Further, FIG. 6B illustrates the interrelation of actuator drawbars 30 and the grooves in guide plate 48 in which drawbars 30 slide.

The structure of actuator drawbar 30 will be described with reference to FIGS. 7A–B and 8A–B. As shown in the top and side views of FIGS. 7A and 7B, actuator drawbar 30 comprises a metal drawbar support strip 84 having a molded plastic interposer body 86 attached thereto by retaining tabs 88. The actuator drawbar 30 is fabricated in a two-step process, including the blanking of metal strips 84 and the molding of interposer body 86 on metal strip 84. This method prevents post-mold shrinkage due to the engagement of interposer body 86 with metal strip 84. Further, the structure of the actuator drawbar provides structural stability in the actuator drawbar, thereby preventing the actuator drawbar 30 from being distorted when subject to the actuating forces used to open contacts 24.

Figure 8A:
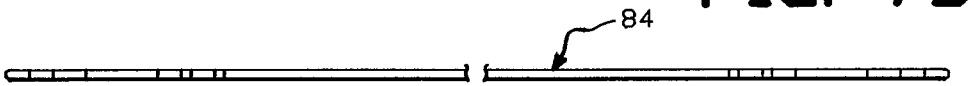
FIG. 8A is a top view of a metal drawbar support strip.
Figure 8B:
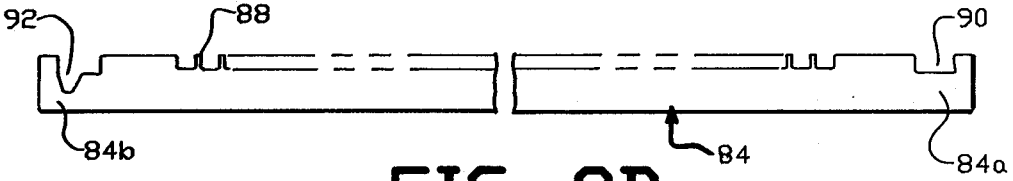
FIG. 8B is a side view of a metal drawbar support strip.

FIGS. 8A and 8B are top and side views of metal drawbar support strip 84. The metal drawbar support strip has a first end **84*a* and a second end 84*b*. The first end 84*a* is the pulling end of the actuator drawbar 30 and has an actuator cutout 90 for engaging with actuator mechanism 46. The second end 84*b* is the return end and has a bias spring output 92 to accept bias spring 60. Retaining tabs 88 are provided along the top edge of metal drawbar support strip 84**.

Figure 9:
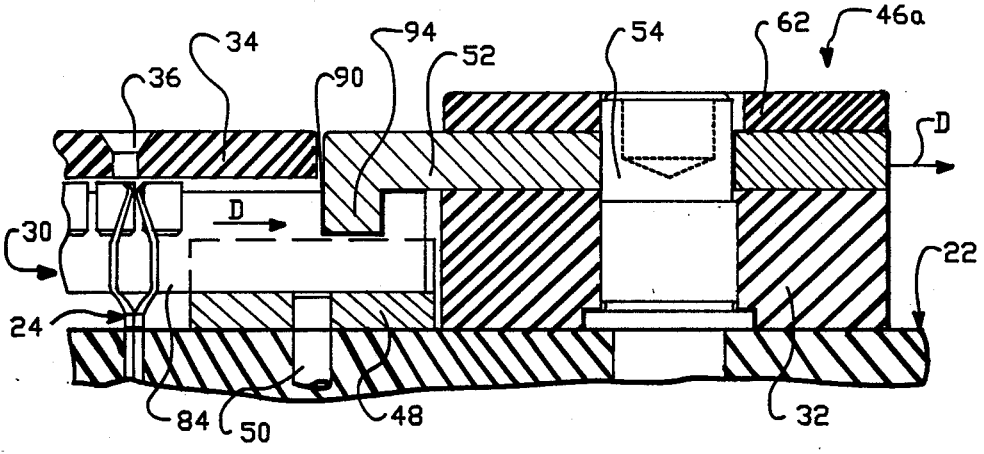
FIG. 9 is sectional view of an actuating mechanism and the pulling side of an actuator drawbar of a PGA ZIF connector in accordance with the present invention.

The actuator mechanism 46, the operation thereof, and the interaction of the actuating mechanism 46 with drawbars 30 will be described with reference to FIGS. 1, 9, and 10. FIG. 9 shows foot 94 of camming slide 52 of a first actuating mechanism **46*a* engaged with actuator cutout 90 at the pulling end of drawbar 30. Camming slide 52 slides in the direction indicated by arrow D (FIG. 9) when eccentric (or a cam) 54 is rotated 180° by an actuator tool 56. The sliding motion of camming slide 52 is guided by slide guide walls 58 and slide cover 62**.

Figure 10:
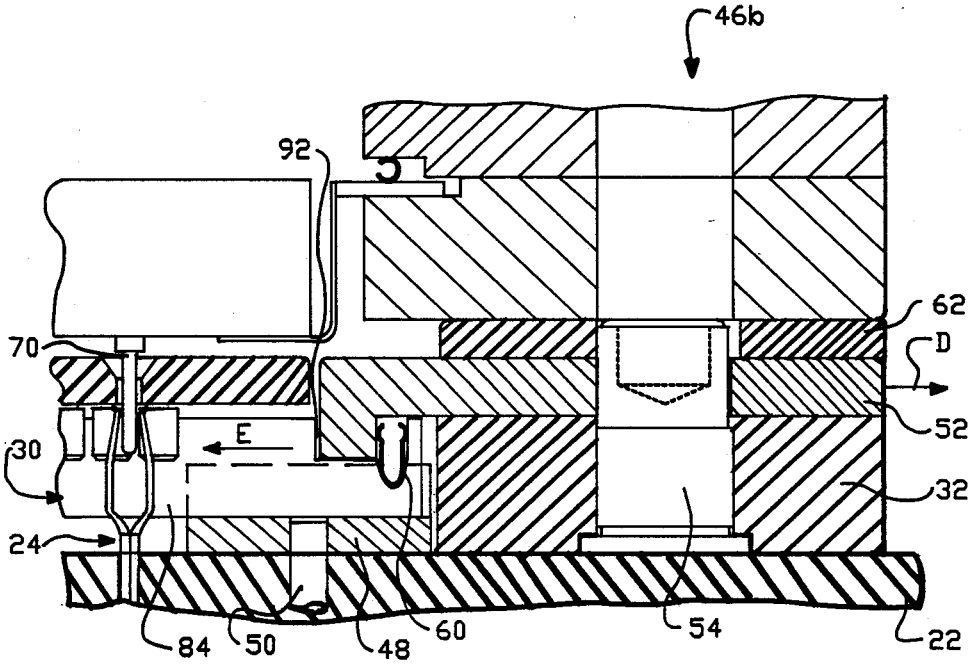
FIG. 10 is a sectional view of an actuating mechanism and the return side of an actuator drawbar of PGA ZIF connector in accordance with the present invention.

FIG. 10 illustrates the interrelation of the return end of a drawbar 30 and a second actuator mechanism **46*b*. At the return end of drawbar 30, foot 94 of camming slide 52 sits in bias spring output 92 of drawbar 30. Return spring 60 resides between foot 94 and drawbar 30. Return spring 60 allows drawbar 30 to move in the direction shown by arrow E when pulled by actuating mechanism 46*a* at the pulling end of drawbar 30, and provides a force which facilitates the return of drawbar 30 to the resting position. Further, return spring 60 allows camming slide 52 of actuating mechanism 46*b* to slide in direction D without moving drawbar 30 during the movement of drawbars 30 which have their pulling end attached to camming slide 52 of actuating mechanism 46*b*; as discussed above, alternating drawbars 30 are caused to slide in opposite directions by having their pulling ends attached to actuating mechanisms 46 located at opposite ends of the rows of contacts 24**.

What is claimed is:

1. A zero insertion force connector, comprising:

a motherboard;

a plurality of contacts provided in rows on said motherboard;

plural drawbar means for engaging said contacts, each said drawbar means being provided between adjacent rows of contacts;

actuator means for moving alternate drawbar means in opposite directions to engage said plural drawbar means with said contacts and to actuate said contacts.

2. A zero insertion force connector according to claim 1, wherein:

said contacts are normally closed contacts;

each said contact comprises a pair of opposed tines;

each said tine includes an actuation tab; and said drawbar means engage said actuation tabs to open said contacts.

3. A zero insertion force connector according to claim 2, wherein said actuation tabs of each of said opposed tines of each said contact are engaged by drawbar means on opposite sides of the row of contacts in which said contact resides.

4. A zero insertion force connector according to claim 1, wherein:

said plurality of contacts comprises first and second type contacts;

alternating rows of contacts respectively comprise first and second type contacts; and each said contact comprises a front tine and a back tine, said front tines of said first type contact engage a drawbar means which slides in one direction, said back tines of said first contact type engaging a drawbar means which slides in the other direction, said front tines of said second type contact engaging a drawbar means which slides in said other direction, and said back tines of said second contact type engaging a drawbar means which slides in said one direction.

5. A zero insertion force connector according to claim 4, wherein each said front and back time comprises an actuation tab for engaging a said drawbar means.

6. A zero insertion force connector according to claim 1, wherein each said drawbar means comprises a drawbar support strip for engaging said actuator means and an interposer body attached to said drawbar support strip for engaging said contacts.

7. A zero insertion force connector according to claim 6, wherein said drawbar support strip comprises a metal strip having retaining tabs and said interposer body is a molded body molded to said retaining tabs.

8. A zero insertion force connector according to claim 4, wherein each said drawbar means comprises a drawbar support strip for engaging said actuator means and an interposer body attached to said drawbar support strip for engaging said contacts.

9. A zero insertion force connector according to claim 8, wherein said drawbar support strip comprises a metal strip having retaining tabs and said interposer body is a molded body molded to said retaining tabs.

10. A zero insertion force connection according to claim 1, wherein said contacts are press-fit in said motherboard.

11. A zero insertion force connection according to claim 9, wherein said contacts are press-fit in said motherboard.

12. A zero insertion force connector according to claim 1, wherein:

each said drawbar means has a pulling end and a return end;

said actuator means moves first and second groups of said drawbar means in opposite directions;

said actuator means comprises first and second actuating mechanisms provided at opposite ends of said drawbar means;

said first actuating mechanism engages said pulling ends of said first group of drawbar means; and said second actuating mechanism engages said pulling ends of said second group of drawbar means.

13. A zero insertion force connector according to claim 4, wherein: eaoh said drawbar means has a pulling end and a return end;

said actuator means moves first and second groups of said drawbar means in opposite directions;

said actuator means comprises first and second actuating mechanisms provided at opposite ends of said drawbar means;

said first actuating mechanism engages said pulling ends of said first group of drawbar means; and said second actuating mechanism engages said pulling ends of said second group of drawbar means.

14. A zero insertion force connector according to claim 12, further comprising a plurality of return springs provided between respective ones of said return ends of said first group of drawbar means and said second actuating mechanism and between respective ones of said return ends of said second group of drawbar means and said first actuating mechanism.

15. A zero insertion force connector including a motherboard and a plurality of normally closed contacts each having two tines provided in rows on the motherboard, characterized in that:

a plurality of drawbar means are provided between said rows of contacts or engaging one of the tines of each contact in the rows of contacts on opposite sides of each of said drawbar means; and actuator means are provided for sliding alternating drawbar means in opposite directions to engage the drawbar means with said tines to open said contacts.

16. A zero insertion force connector according to claim 15, further characterized in that:

said plurality of contacts comprises first and second type contacts;

alternating rows of contacts respectively comprise first and second type contacts; and each said contact comprises a front tine and a back tine, said front tines of said first type contact engaging a drawbar means which slides in a first direction, said back tines of said first contact type engaging a drawbar means which slides in a second direction, said front tines of said second type contact engaging a drawbar means which slides in a second direction, and said back tines of said second contact type engaging a drawbar means which slides in a first direction.

17. A zero insertion force connector according to claim 15, further characterized in that each said front and back tine comprises a tab for engaging a respective one of said drawbar means.

18. A zero insertion force connector according to claim 15, further characterized in that said drawbar means comprise a drawbar support strip and an interposer body attached to said drawbar support strip, said drawbar support strip engaging said actuator means and said interposer body engaging said contacts.

19. A zero insertion force connector according to claim 16, further characterized in that:

each said drawbar means has a pulling end and a return end;

said actuator means moves first and second groups of said drawbar means in opposite directions;

said actuator means comprises first and second actuating mechanisms provided at opposite ends of said drawbar means;

said first actuating mechanism engages said pulling ends of said first group of drawbar means; and said second actuating mechanism engages said pulling ends of said second group of drawbar means.

20. A zero insertion force connector according to claim 19, further characterized in that:

a plurality of return springs provided between respective ones of said return ends of said first group of drawbar means and said second actuating mechanism and between respective ones of said return ends of said second group of drawbar means and said first actuating mechanism.

21. A zero insertion force connector, comprising:

a motherboard;

plural rows of normally closed contacts provided in said motherboard, alternate ones of said rows of contacts respectively comprising first and second type contacts, each said first and second type contact having a front tine and a back tine;

a plurality of drawbar means provided between respective ones of the rows of first and second type contacts, said drawbar means being slidably engageable with said contacts in the rows of contacts on each side of a said drawbar means; and an actuator means for sliding a first group of drawbar means, including alternate ones of said drawbar means in a first direction, so that said first group of drawbar means engage and displace the front tines of the first type contacts and the back tines of the second type contacts, and for sliding a second group of drawbar means, including alternate other ones of said drawbar means so that said second group of drawbar means engage and displace the front tines of the second type contacts and the back tines of the first type contacts, thereby opening said contacts.

22. A zero insertion force connector according to claim 21, further comprising a plurality of return springs provided between respective ones of said return ends of said first group of drawbar means and said second camming means and between respective ones of said return ends of said second group of drawbar means and said first camming means.

23. A zero insertion force connector according to claim 22, wherein each said drawbar means comprises a drawbar support strip for engaging said actuator means and an interposer body attached to said drawbar support strip for engaging said contacts.

24. A zero insertion force connector according to claim 23, wherein said drawbar support strip comprises a metal strip having retaining tabs and said interposer body is a molded body molded to said retaining tabs.

25. A pin grid array (PGA) zero insertion force (ZIF) connector, comprising:

a motherboard;

at least 10,000 normally closed contacts provided in n rows on said motherboard, said contacts including first and second type contacts, alternating ones of said rows of contacts including contacts of said first and second types, each said contact including a front tine and a black tine;

n+1 drawbars provided in parallel with said rows of contacts, said drawbars having interposers for engaging said tines of said contacts and having first and second ends;

first camming means provided on said motherboard at said first ends of said drawbars, for sliding a first group of alternate ones of said drawbars towards said first camming means so that said interposers of said first group of drawbars engage and open said front tines of said first type contacts and said back tines of said second type contacts; and second camming means provided on said motherboard at said second ends of said drawbars, for sliding a second group of alternate other ones of said drawbars toward said second camming means so that said interposers of said second group of drawbars engage and open said back tines of said first type contacts and said front tines of said second type contacts.

26. A PGA ZIF connector according to claim 25, wherein said first and second camming means each comprise at least two camming sections.

27. A PGA ZIF connector according to claim 25, further comprising first and second guide plates provided on said motherboard at respective ones of said first and second ends of said actuator drawbars, said guide plates having grooves, wherein said actuator drawbars slide in said grooves of said guide plates.

28. A PGA ZIF connector according to claim 25, wherein said contacts are provided on said motherboard with a pitch of less than or equal to 0.070 inches.

* * * * *